United States Patent [19]

Roseboom

[11] 4,114,888

[45] Sep. 19, 1978

[54] GOLF TOUR GAME

[75] Inventor: Wayne L. Roseboom, Morris, N.Y.

[73] Assignee: The Raymond Lee Organization, Inc., New York, N.Y. ; a part interest

[21] Appl. No.: 785,735

[22] Filed: Apr. 8, 1977

[51] Int. Cl.[2] ..... A63B 69/36

[52] U.S. Cl. ..... 273/176 L; 273/184 B; 206/315 R

[58] Field of Search ..... 273/176 L, 184 B, 134 CG, 273/87.2, 87.4, 87 R, 87 C, 87 H, 185 D, 200 R, 200 A, 200 B, 197 R, 197 A; 35/29 A; 206/315 R

[56] References Cited

U.S. PATENT DOCUMENTS

| | | | |
|---|---|---|---|
| 1,470,117 | 10/1923 | MacRae | 273/176 L |
| 1,804,040 | 5/1931 | Tannehill | 273/184 B |
| 3,819,185 | 6/1974 | Lowther | 273/134 CG |

*Primary Examiner*—George J. Marlo
*Attorney, Agent, or Firm*—Daniel Jay Tick

[57] ABSTRACT

A plurality of distinctly different 18 hole golf tournament maps are stored in rolled condition on separate rollers in a carrying case. A golf ball driving unit simulates how far a driven golf ball will travel. The golf ball driving unit comprises a housing having an upright shaft rotatably mounted therein. An arm extends perpendicularly from the shaft and is freely rotatable with the shaft in a plane perpendicular to the shaft. A golf ball is affixed to the free end of the arm. A counter in the housing is coupled to the shaft for counting the revolutions of the shaft and indicating the number of revolutions on a distance scale thereby indicating to a user driving the golf ball wtih a golf club how far the driven ball travels to a selected hole on a selected one of the maps. A marking device indicates the distance of a drive on a selected map.

1 Claim, 6 Drawing Figures

GOLF TOUR GAME

BACKGROUND OF THE INVENTION

The present invention relates to a golf tour game.

Objects of the invention are to provide a golf tour game of simple structure, which is inexpensive in manufacture, and provides very good indoor practice for golfers, as well as interest and entertainment.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
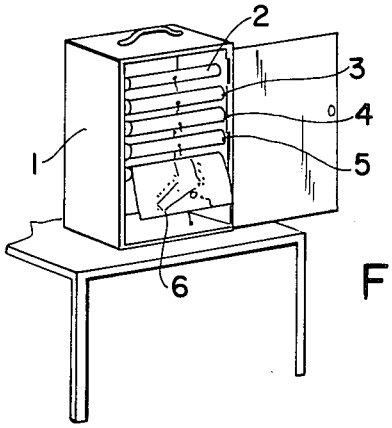
FIG. 1 is a perspective view of an embodiment of the carrying case of the tour game of the invention.
Figure 5:
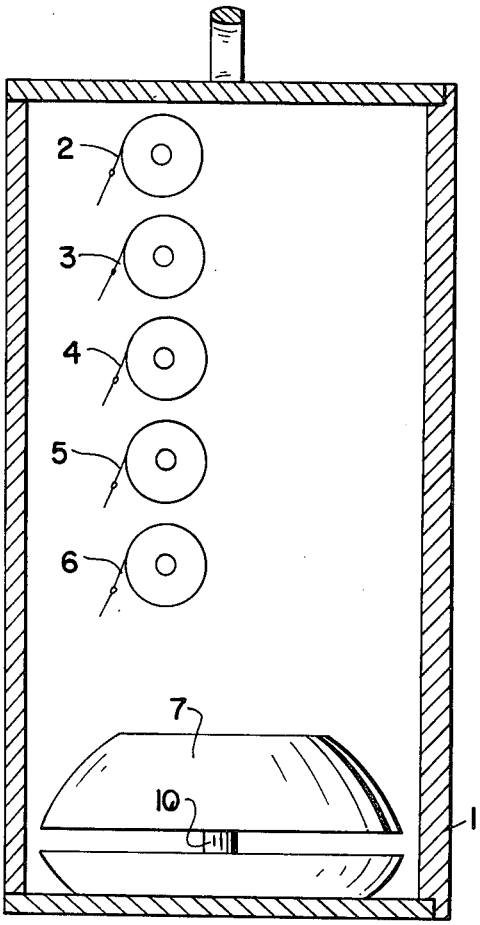
FIG. 5 is a view, on an enlarged scale, partly in section, of the carrying case of FIG. 1 and the golf ball driving unit of FIG. 2 stored therein.

The golf tour game of the invention comprises a carrying case 1 (FIGS. 1 and 5). A plurality of 18 hole golf tournament maps 2, 3, 4, 5 and 6 are stored in rolled condition in the carrying case 1, as shown in FIGS. 1 and 5. Each of the tournament maps is a map of a different golf course and each shows the location of the holes of such course. Each of the tournament maps 2 to 6 is wound on a roller so that it may be conveniently rolled thereon for storage in the carrying case 1 and unrolled therefrom for use.

Figure 2:
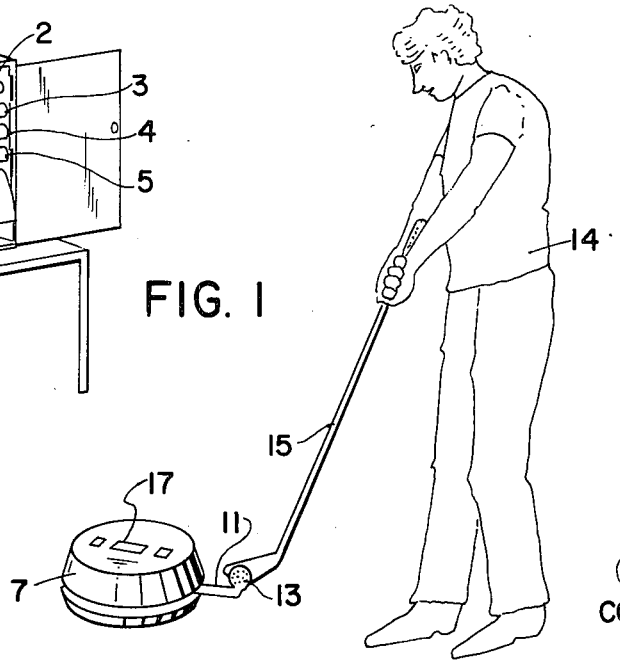
FIG. 2 is a perspective view of an embodiment of the golf ball driving unit of the invention in use.
Figure 3:
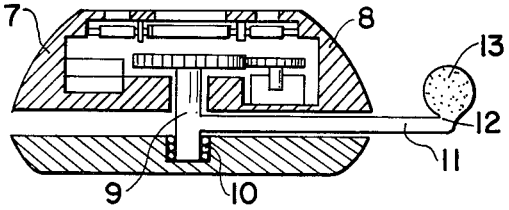
FIG. 3 is a view, on an enlarged scale, partly in section, of the embodiment of FIG. 2.

A golf ball driving unit 7 (FIGS. 2, 3 and 5) simulates how far a driven golf ball will travel. The golf ball driving unit 7 comprises a housing 8 having an upright shaft 9 with a tubular shaft coaxially rotatably mounted therein on the shaft 9 in the housing via bearings 10, and so on, as shown in FIG. 3. An arm 11 extends substantially perpendicularly from the tubular shaft around the shaft 9 and has a free end 12 (FIG. 3) extending in spaced relation with the housing. The arm 11 is freely rotatable with the tubular shaft around the shaft 9 in a plane substantially perpendicular to said shaft. This is accomplished by dividing the housing 8 into two parts, secured to each other via the shaft 9 and spaced from each other to form a gap between the parts of the housing sufficient to permit clearance of the arm 11.

A golf ball 13 (FIGS. 2 to 4) is affixed to the free end 12 of the arm 11. Thus, when a user 14 (FIG. 2) drives the ball 13 with a golf club 15, the arm 11, and therefore the tubular shaft around the shaft 9, rotates about the axis of said shaft.

Figure 4:
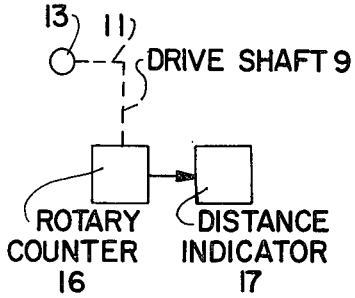
FIG. 4 is a block diagram of the embodiment of FIGS. 2 and 3.

As shown in FIG. 4, a counting device is provided in the housing 8 and is coupled to the tubular shaft around the shaft 9 for counting the revolutions of said tubular shaft. The counting device preferably comprises a rotary counter 16 of any suitable type. A distance indicator or scale 17 (FIG. 4) is connected to the output of the rotary counter 16 and indicates the number of revolutions of the tubular drive shaft around the shaft 9 on a distance scale. Thus, the user 14 has an indication of how far the ball driven by him or her travels to a selected hole on a selected one of the maps 2 to 6.

Figure 6:
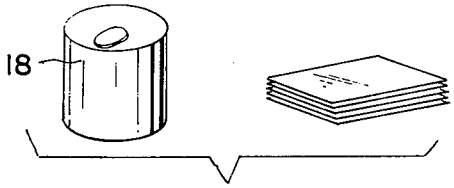
FIG. 6 is a perspective view, on an enlarged scale, of an embodiment of a marking device and a plurality of score pads of the golf tour game of the invention.

A marking device of any suitable type, which may comprise a cup 18 with a marker, as shown in FIG. 6, is used by the golfer to indicate the distance of a drive on a selected one of the maps 2 to 6.

Each of the tournament maps 2 to 6 is preferably an exact replica of a golf course such as, for example, a PGA golf course like the Bob Hope Desert Classic, the Indian Wells Country Club, the Palm Desert, the Andy Williams San Diego Open, the Torrey Pines Country Club, the Glen Campbell Los Angeles Open, the Riviera Country Club, and so on. Each of the maps is in color and indicates bunkers, trees, sand traps, ponds, and so on.

After each "shot", the golfer reads the distance indicated on the distance indicator 17 and places a marker on the map of the course being played. He or she then resets the indicator to zero, so that it may indicate the yardage of the next "shot" or drive. The marker preferably is removably adhesive to the map.

While the invention has been described by means of a specific example and in a specific embodiment, I do not wish to be limited thereto, for obvious modifications will occur to those skilled in the art without departing from the spirit and scope of the invention.

I claim:

1. A golf tour game, comprising a carrying case;

a plurality of distinctly different 18 hole golf tournament maps stored in rolled condition in the carrying case on separate rollers whereby a golfer may select and unroll a particular golf course to be played;

a golf ball driving unit for simulating how far a driven golf ball will travel, said golf ball driving unit comprising a housing having an upright shaft rotatably mounted therein, an arm extending substantially perpendicularly from the shaft and having a free end extending in spaced relation with the housing, said arm being freely rotatable with said shaft in a plane substantially perpendicular to the shaft, a golf ball affixed to the free end of the arm, and counting means in the housing coupled to said shaft for counting the revolutions of said shaft and indicating the number of revolutions on a distance scale thereby indicating to a user driving the golf ball with a golf club how far the driven ball travels to a selected hole on a selected one of the maps; and a marking device for indicating the distance of a drive on a selected map.

* * * * *